United States Patent [19]

Takubo

[11] Patent Number: 4,770,276

[45] Date of Patent: Sep. 13, 1988

[54] OIL PAN FOR AUTOMOTIVE ENGINE

[75] Inventor: Hiroichi Takubo, Hiroshima, Japan

[73] Assignee: Mazda Motor Corporation, Hiroshima, Japan

[21] Appl. No.: 37,928

[22] Filed: Apr. 13, 1987

[30] Foreign Application Priority Data

Apr. 23, 1986 [JP] Japan ..... 61-60143[U]

[51] Int. Cl.[4] ..... F01M 11/00

[52] U.S. Cl. ..... 184/106; 123/195 C

[58] Field of Search ..... 123/195 C; 184/106

[56] References Cited

U.S. PATENT DOCUMENTS

| | | | |
|---|---|---|---|
| 1,281,548 | 10/1918 | Frederick | 184/106 |
| 1,293,266 | 2/1919 | Warren | 184/106 X |
| 1,892,185 | 12/1932 | Clements | 184/106 X |
| 2,002,211 | 5/1935 | Torney | 184/106 |
| 2,577,188 | 12/1951 | Hall | 184/106 |
| 3,942,502 | 3/1976 | Gorres et al. . | |
| 4,285,309 | 8/1981 | Johansson | 123/19 SC |
| 4,394,853 | 7/1983 | Lopez-Crevillan et al. | 184/106 |
| 4,394,982 | 8/1983 | Moller | 123/19 SC |
| 4,457,274 | 7/1984 | Gottlob | 123/19 SC |
| 4,515,119 | 5/1985 | Hayashi et al. . | |
| 4,682,672 | 7/1987 | Berger et al. | 184/106 |

FOREIGN PATENT DOCUMENTS

| | | | |
|---|---|---|---|
| 1102169 | 10/1955 | France | 184/106 |
| 581948 | 9/1958 | Italy | 184/106 |

*Primary Examiner*—Carlton R. Croyle
*Assistant Examiner*—T. Olds
*Attorney, Agent, or Firm*—Burns, Doane, Swecker & Mathis

[57] ABSTRACT

An oil pan structure of generally rectangular cup-like configuration having a rear end adapted to be connected with a clutch housing, which comprises reinforcement wall structure formed with the oil pan structure so as to protrude away from the rear end towards the clutch housing. The reinforcement wall structure defines a space between the rear end of the oil pan structure and the clutch housing when the oil pan structure is secured to the clutch housing, and has a portion cut away to define an access opening communicated with the space The access opening is located immediately below at least one bolt receiving boss formed in the rear end of the oil pan structure for the passage of a fitting bolt used to connect the oil pan structure from below to a cylinder block. The oil pan structure also comprises a cover member removably fitted to the reinforcement wall structure for closing the access opening.

10 Claims, 5 Drawing Sheets

OIL PAN FOR AUTOMOTIVE ENGINE

BACKGROUND OF THE INVENTION

1. Field of the Invention

The present invention relates to an oil pan structure for an automotive engine.

2. Description of the Prior Art

In most automotive engines now in use, the cylinder block is connected at a rear end with a clutch housing and then with a transmission housing to complete a substantially automotive power plant. The power plant is, therefore, elongated in configuration and is prone to bending under the influence of oscillations and vibrations occurring in the power plant during the operation of the engine.

In order to substantially eliminate, or minimize, the bending of the power plant, or engine bending for short, gusset plates are utilized between the cylinder block and the transmission housing to increase the rigidity of the engine system as a whole. According to the well established automotive practice, the gusset plates are fitted outboard of the engine cylinder and the transmission housing and, therefore, it has long been encountered with a problem in that, since the fitting of the gusset plates outboard of the engine cylinder and the transmission housing imposes limitations to the design of engine layout, not only does the servicing of the engine and its associated parts tend to be hampered, but also the weight of the power plant tends to be increased.

In order to substantially obviate the above problem, U.S. Pat. No. 3,942,502, patented Mar. 9, 1976, discloses a technique wherein the oil pan, secured to the bottom of the cylinder block to define a crankcase in cooperation with the cylinder block, is formed at its rear end with a coupling flange through which the oil pan is connected with the clutch housing. The oil pan is formed with reinforcement ribs on each side thereof to reinforce the connection, and hence to increase the rigidity of connection, between the cylinder block and the clutch housing so that the engine bending can be substantially minimized.

However, it has been found that, since the rear end of the oil pan is connected directly with the clutch housing through the coupling flange according to the above mentioned U.S. patent, not only are complicated and time-consuming fitting procedures required to connect the rear end of the oil pan to the clutch housing, but also the servicing of internal parts of the clutch housing is not easy to accomplish.

While less relevant to the present invention, another approach to minimize the engine bending is to use the crankshaft bearing beam designed to have its rear end adapted to be flangedly connected directly with the transmission housing, such as disclosed in U.S. Pat. No. 4,515,119, patented May 7, 1985.

SUMMARY OF THE INVENTION

Accordingly, the present invention has been devised with a view to substantially eliminating the above discussed problem inherent in the prior art oil pan structure and has for its essential object to provide an improved oil pan structure effective to ensure an increased rigidity of connection relative to the clutch housing and also effective to facilitate the fitting of the oil pan to the clutch housing while facilitating an easy servicing of the internal parts of the clutch housing.

According to the present invention, the oil pan is provided with a reinforcement wall protruding from the rear wall thereof in a direction close towards the clutch housing so as to form a space in cooperation with the rear end wall of the oil pan and the clutch housing when the clutch housing is connected with the oil pan. A portion of the reinforcement wall immediately beneath at least one bolt hole defined in a flange integral with the rear end wall for the passage of a bolt therethrough to connect the oil pan and the engine cylinder together is cut out to define an access opening communicated with the space. While the oil pan is of one-piece construction together with the reinforcement wall, a cover plate separate from the oil pan is provided for removably closing the access opening.

With the oil pan so constructed as hereinabove described, the oil pan can be connected with the clutch housing not only through the flange of the rear end wall thereof, but also through the reinforcement wall and, therefore, the substantially increased rigidity of connection can be obtained between the engine and the clutch housing.

Also, when the engine and the clutch housing are to be connected together, the presence of the space between the cylinder block and the clutch housing and the access opening defined in the reinforcement wall in communication with such space permits a quick and efficient access of the bolt to the bolt hole in readiness for the connection of the flange of the rear end wall with the clutch housing and also permits an access to internal parts of the clutch housing for servicing purpose. However, after the cylinder block and the clutch housing have been connected together, the access opening is closed by the cover plate. This cover plate serves not only to close the access opening as hereinabove described, but also to minimize the emission of noise from the space to the exterior of the power plant.

In addition to the foregoing features derived from the present invention, the cover plate necessitated because of the presence of the access opening brings about the following additional feature. As is well known to those skilled in the art, in the case of the automotive vehicle of front-mounted engine, rear drive type, that is, wherein the engine is mounted at the front with the rear wheels driven thereby, it is common for the engine to be supported in a generally inclined fashion with the rear end thereof lowered relative to the front end thereof and, therefore, it may often happen that the level of oil contained within the oil pan may raise above the level of the joint face between the cylinder block and the oil pan. Once this happens frequently, oil leaking through the joint may run on respective portions of the outer surfaces of the cylinder block and the oil pan adjacent such joint with the consequence that portions of the outer surfaces of the cylinder block and the oil pan are stained with oil, accompanied by reduction in aesthetic appearance of the engine system as a whole.

However, according to the present invention, the oil-stained area, which particularly exists at the rear of the engine, can be advantageously concealed by the cover plate and, therefore, any possible reduction in aesthetic appearance can be avoided.

BRIEF DESCRIPTION OF THE DRAWINGS

This and other object and features of the present invention will become clear from the following description taken in conjunction with a preferred embodiment thereof with reference to the accompanying drawings, in which.

DETAILED DESCRIPTION OF THE EMBODIMENT

Figure 1:
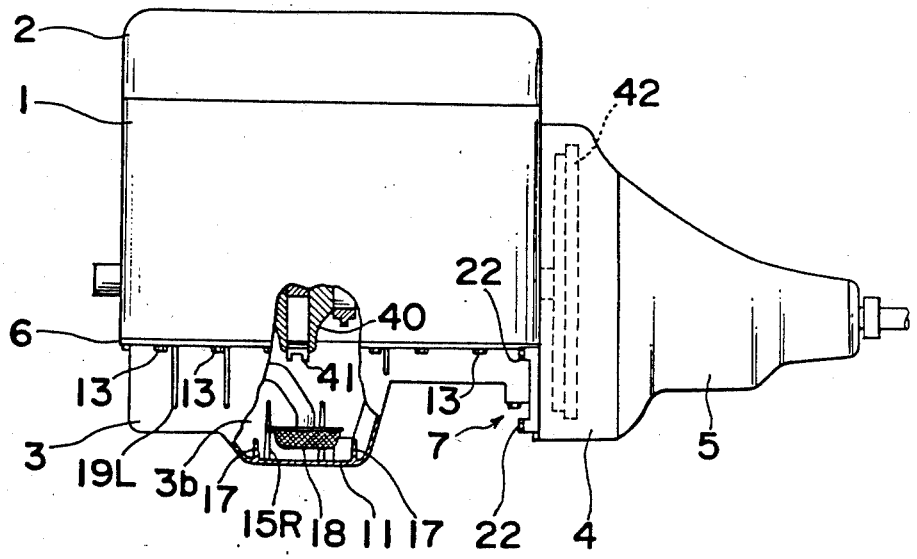
FIG. 1 is a schematic side view, with a portion cut away, of an automotive power plant including an engine, a clutch housing and a transmission housing.
Figure 4:
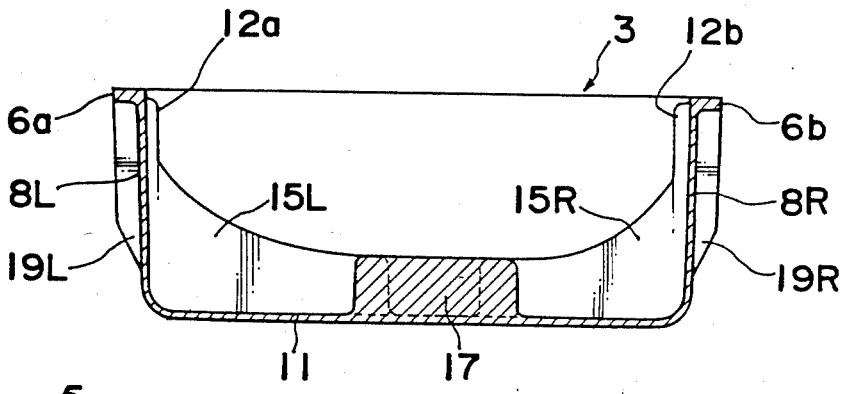
FIGS. 4, 5 and 6 are cross-sectional views taken along the lines IV—IV, V—V and VI—VI in FIG. 2.
Figure 5:
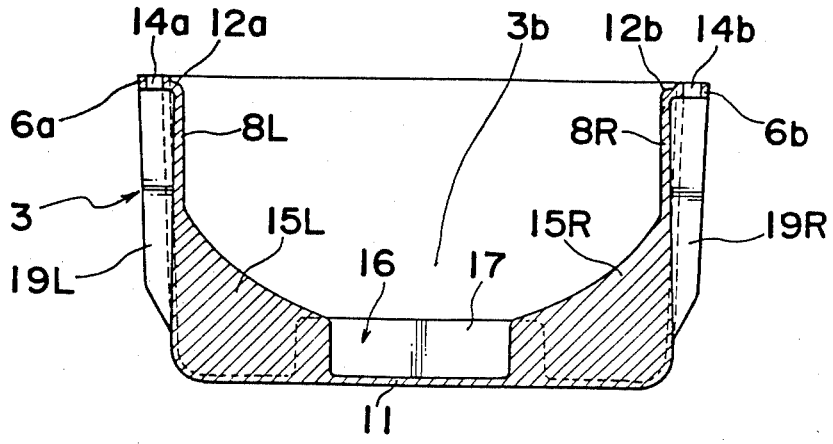
Figure 2:
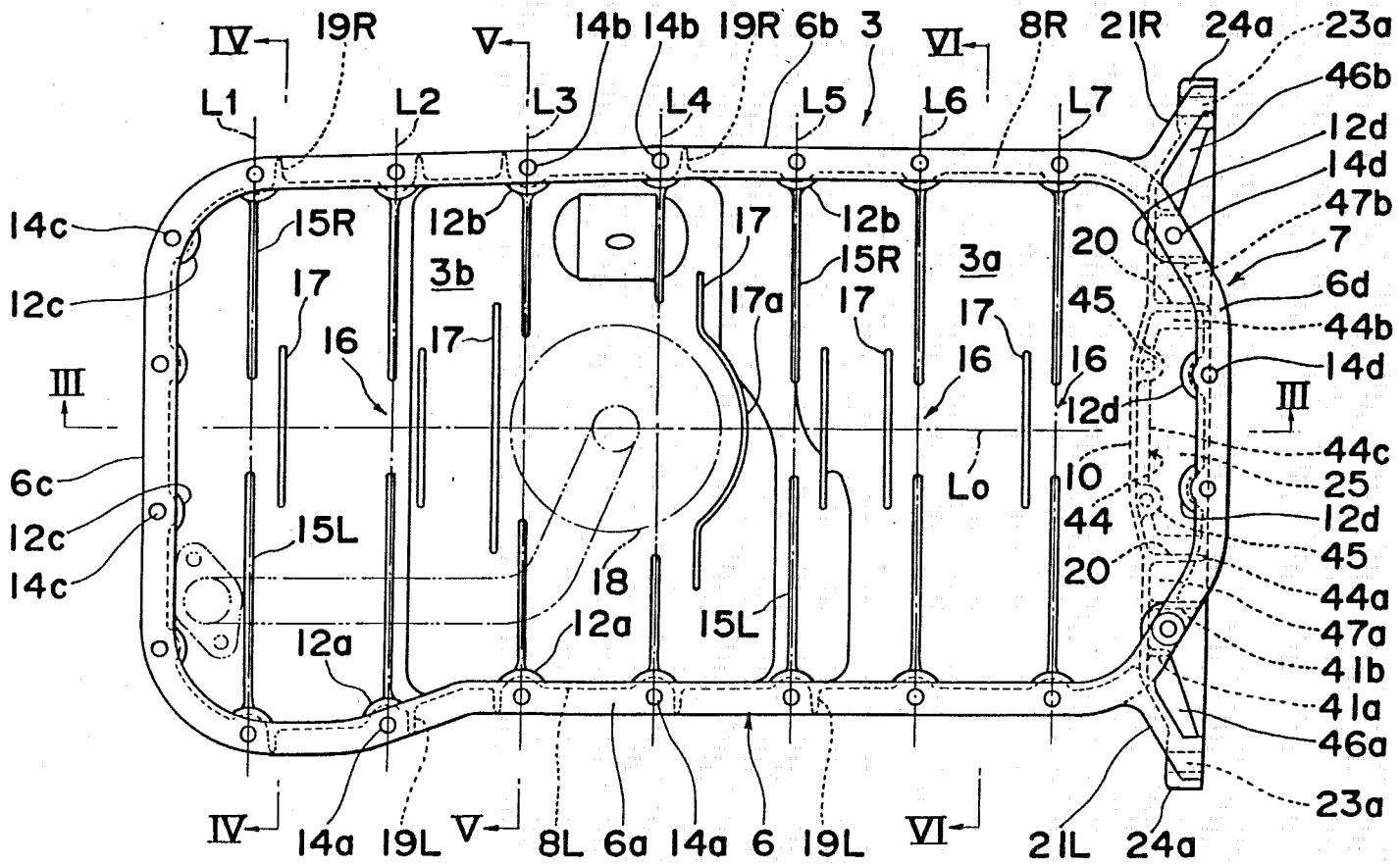
FIG. 2 is a top plan view of an oil pan embodying the present invention.

Referring first to FIG. 1, there is schematically shown an automotive power plant including an engine comprised of a cylinder block 1, a cylinder head 2 mounted on the cylinder block 1, and an oil pan 3 secured to the bottom of the cylinder block 1 by means of a plurality of fitting bolts 13. The power plant also includes a clutch housing 4 secured to a rear end of the engine and a transmission housing 5 secured to a rear end of the clutch housing 4. More specifically, the clutch housing 4 is flangedly connected not only to the rear end face of the cylinder block 1, but also to a rear end of the oil pan 3 and a reinforcement wall structure generally identified by 7 and integrally formed with the oil pan 3 as will subsequently be described in detail.

Figure 3:
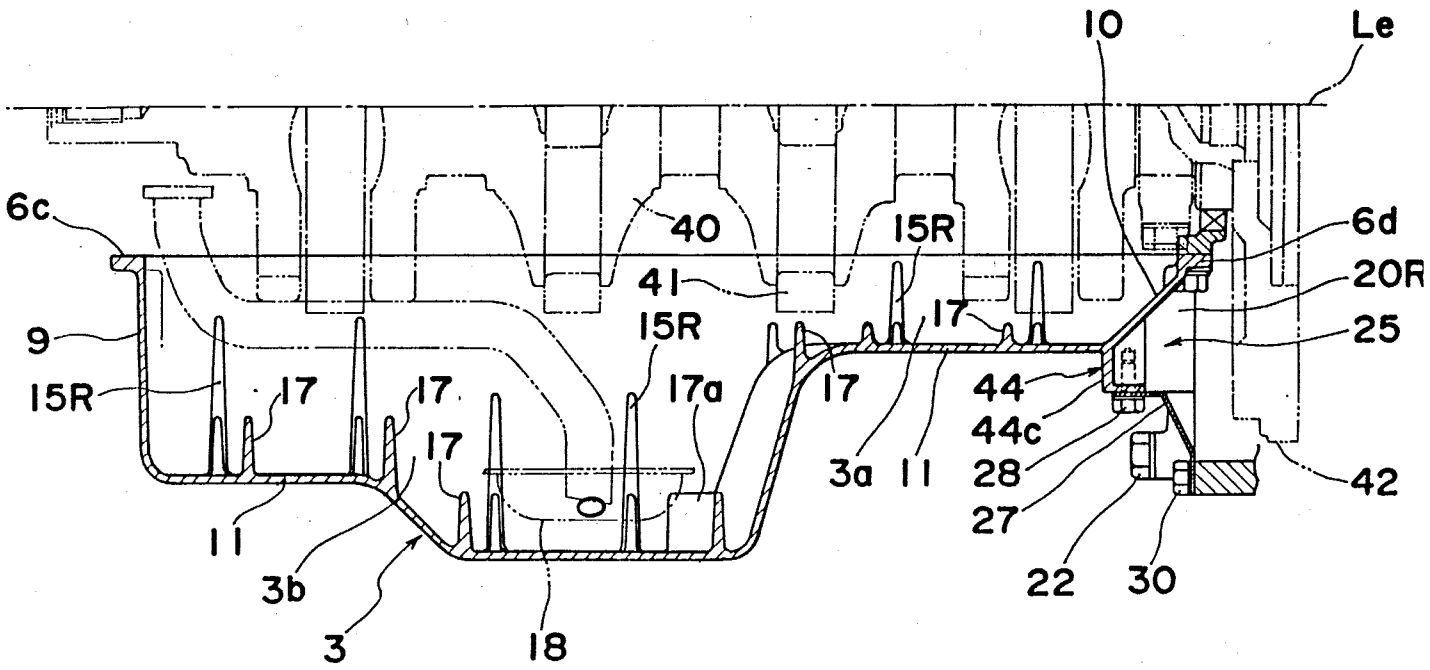
FIG. 3 is a longitudinal side sectional view of the oil pan, taken along the line III—III in FIG. 2.
Figure 6:
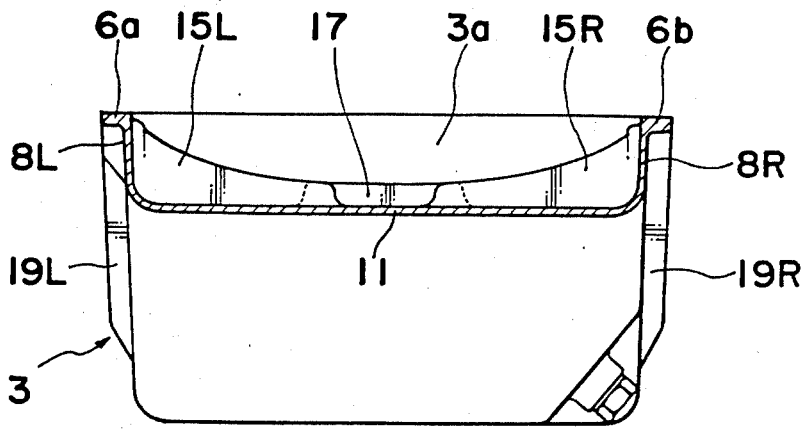

Referring now to the accompanying drawings including FIGS. 2 to 8, the oil pan 3 according to a preferred form of the present invention is of one-piece construction formed of aluminum by the use of any known die casting technique and generally comprised of a pair of side walls 8L and 8R, front and rear walls 9 and 10, and a bottom wall 11, all assembled or cast together to render to the oil pan 3 to represent a generally rectangular cup-like configuration opening upwards, as viewed in FIGS. 1 and 3 to 7, and towards the bottom of the cylinder block 1. As best shown in FIGS. 1 and 3, the oil pan 3 has a shallow region 3*a*, defined therein adjacent the rear end wall 10, and a deep region or sump 3*b* defined therein adjacent the front end wall 9 and, for this purpose, the bottom wall 11 of the oil pan 3 is correspondingly stepped up and down over the length thereof.

The oil pan 3 also has a peripheral flange, generally identified by 6, which is integrally formed therewith so as to protrude laterally outwardly from the peripheral edge around the opening of the oil pan. This peripheral flange 6 is constituted by a pair of side flange sections 6*a* and 6*b* integral with the respective side walls 8L and 8R, and front and rear end flange sections 6*c* and 6*d* integral with the respective front and rear end walls 9 and 10, all of said flange sections 6*a* to 6*d* being continued together to provide a single integer that is referred to as the peripheral flange. It is to be noted that the rear end wall 10 is, as best shown in FIG. 3, inclined relative to the front end wall 9 with the rear end flange section 6*d* offset rearwardly relative to the lower edge of the rear end wall 10 which is continued to the bottom wall 11.

The peripheral flange 6 is formed with a plurality of bosses, some of the bosses formed in the side flange sections 6*a* and 6*b* being identified by 12*a* and 12*b*, whereas some of the bosses formed in the front and rear end flange sections 6*c* and 6*d* are respectively identified by 12*c* and 12*d*. In alignment with these bosses 12*a* to 12*d*, the peripheral flange 6 is formed with bolt holes for the passage of the fitting bolts 13 therethrough; the bolt holes defined in the side flange sections 6*a* and 6*b* being generally identified by 14*a* and 14*b*, respectively, and the bolt holes defined in the front and rear end flange sections 6*c* and 6*d* being generally defined by 14*c* and 14*d*, respectively. The bosses 12*a* defined in the side wall 8R, or the bolt holes 14*a* in the side flange section 6*a* and the bolt holes 14*b* in the side flange section 6*b*, are so paired and so positioned as to lie on respective imaginary lines L1, L2, L3, L4, L5, L6 and L7 all drawn so as to extend at right angles to the longitudinal center line Lo of the oil pan 3, each neighboring imaginary lines being spaced a predetermined distance from each other.

The oil pan 3 has a plurality of, for example, seven, pairs of inner gussets 15L and 15R. The inner gussets 15L of one pair are located in alignment with the respective bosses 12*a* and integral with the side wall 8L and also with the bottom wall 11 while extending from the side wall 8L towards the longitudinal center line Lo and terminating at a respective location spaced a distance inwardly from the longitudinal center line Lo. Similarly, the inner gussets 15R of the opposite pair are located in alignment with the respective bosses 12*b* and integral with the side wall 8R and also with the bottom wall 11 while extending from the side wall 8R towards the longitudinal center line Lo and terminating at a respective location spaced a distance inwardly from the longitudinal center line Lo. In other words, each pair of the inner gussets 15L and 15R extend from the opposite side walls 8L and 8R in a direction close towards each other and towards the longitudinal center line Lo in alignment with each other and also with the respective imaginary line L1, L2, L3, L4, L5, L6 or L7 and terminate at respective locations so spaced a distance from each other as to define a center spacing 16 as best shown in FIGS. 4 to 8. Also, as can be understood from FIGS. 4 to 8, each of the inner gussets 15L and 15R has its height, as measured in a direction from the bottom wall 11 towards the opening of the oil pan 3, which continuously decreases in a direction from a position adjacent the associated side wall 8L or 8R towards the longitudinal center line Lo.

The oil pan 3 also has a plurality of, for example, seven, generally rectangular center ribs 17 integrally formed with the bottom wall 11 with their longitudinal senses lying at right angles to the longitudinal center line Lo, which center ribs 17 are positioned in alignment with the respective center spacings 16 between the paired inner gussets 15L and 15R with their opposite ends spaced from the paired inner gussets 15L and 15R, while partially overlapping therewith as viewed in a direction along the longitudinal center line Lo. Each of the center ribs 17 has a length so selected as to be greater than the size of each center spacing 16 between the associated paired inner gussets 15L and 15R, but smaller than the distance between the opposite side walls 8L and 8R.

Of these center ribs 17, the six center ribs 17 extend parallel to any one of the imaginary lines L1 to L7 while being spaced a distance from the adjacent imaginary line L1 to L7, whereas the remaining center rib 17, which is located substantially intermediate of the length of the bottom wall 11, has its intermediate portion 17*a* so curved as to detour a portion of a generally circularsectioned oil strainer 18 (also see FIG. 1) positioned in the sump 3*b*, the oil strainer 18 being well known to those skilled in the art as to its structure and function. Each of these center ribs 17 is so positioned and so sized that it will not interfere with both the revolution of a crankshaft 40 and the movement of connecting rods 41, both shown by the phantom lines in FIG. 3, wherein the axis of rotations of the crankshaft 40 is shown by Le.

The oil pan 3 is not only internally reinforced by the paired inner gussets 15L and 15R and the center ribs 17, but also externally reinforced by outer gussets 19L and 19R. Each of these outer gussets 19L is integral in part with the side wall 8L and in part with the side flange section 6*a* and is located in alignment with the associated inner gusset 15L, whereas each of the outer gussets 19R is integral in part with the side wall 8R and in part with the side flange section 6*b* and is located in alignment with the associated inner gusset 15R.

Hereinafter, the details of the reinforcement wall structure 7 will be described with particular reference to FIGS. 2, 3, 7 and 8. The reinforcement wall structure 7 comprises a pair of vertically extending angle walls 20L and 20R both integral in part with the rear end wall 10 and in part with the rear end flange section 6d and fitted outboard of the oil pan 3 so as to protrude from the rear end wall 10 in a direction towards the clutch housing 4 as viewed in FIG. 1. The reinforcement wall structure 7 also comprises a shell 40 of generally semicircular cross-sectional shape as viewed in a direction conforming to the longitudinal center line Lo of the oil pan 3, which shell 40 is integrally formed with the rear end wall 10 and also with respective lower ends, as viewed in FIGS. 7 and 8, of the angle walls 20L and 20R so as to protrude in a direction longitudinally of the oil pan 3 and towards the clutch housing 4.

Figure 8:
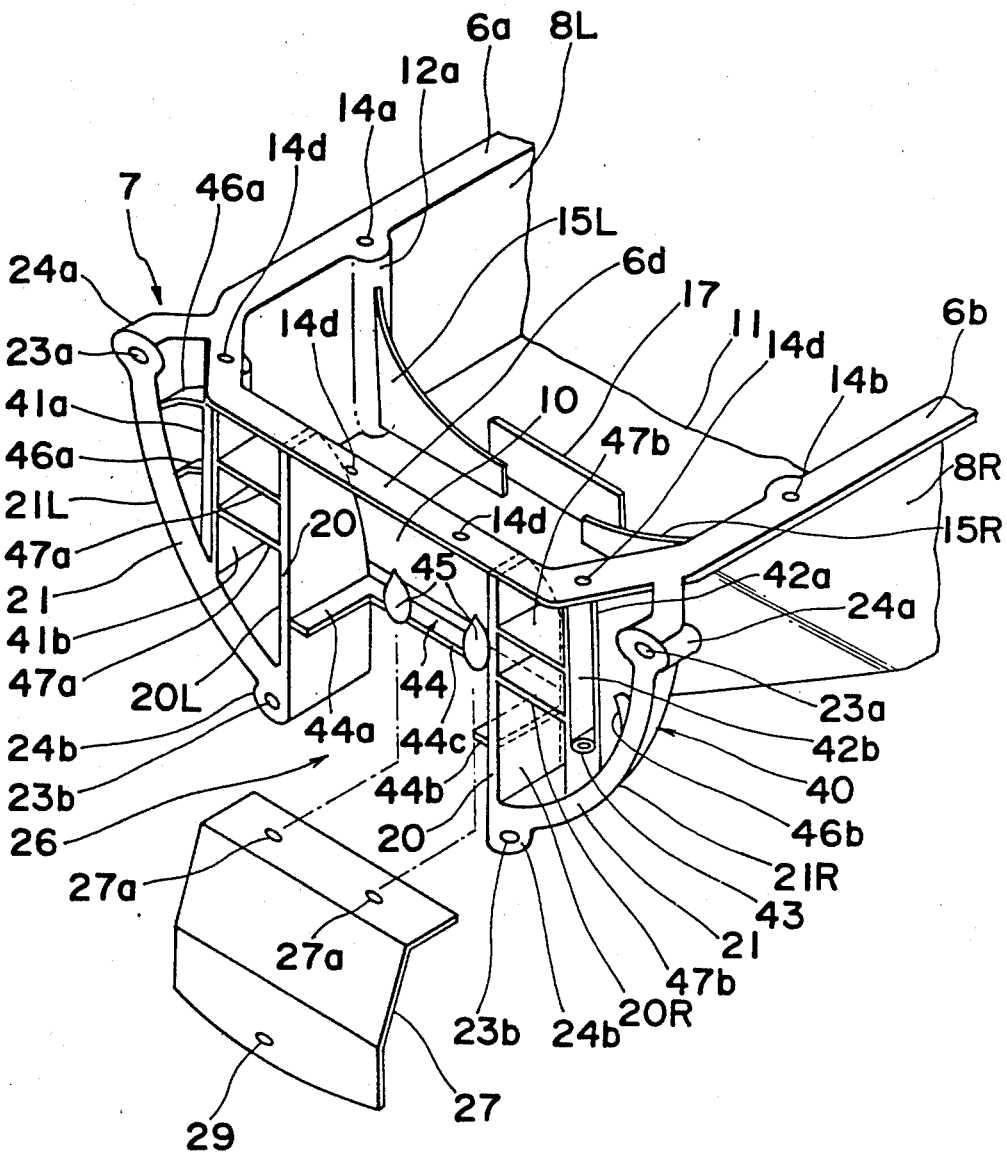
FIG. 8 is a perspective view, on an enlarged scale, of a rear end portion of the oil pan.

As best shown in FIG. 8, a portion of the shell 40 delimited between the angle walls 20L and 20R is cut away so as to define an access opening 26, located immediately beneath the two intermediate bolt holes 14*d* in the rear end flange section 6*d*, while dividing the shell 40 into left-hand and right-hand shell segments 21L and 21R. It is to be noted that the angle walls 20L and 20R have respective vertically extending joint faces, generally identified by 20 and, similarly, the shell segments 21L and 21R have respective, generally arcuate joint faces generally identified by 21, all of said joint faces 20 and 21 facing in a direction counter to the rear end wall 10 and adapted to be brought into abutment with the clutch housing 4 when the oil pan 3 and the clutch housing 4 are connected together in a manner which will become clear from the subsequent description.

Within a space delimited by each of the shell segments 21L and 21R, a portion of the rear end wall 10 confronting the adjacent shell segment 21L or 21R and the angle wall 20L or 20R adjacent such shell segment 20L or 20R, a pair of parallel walls 41*a* and 41*b*, or 42*a* and 42*b*, are integrally formed in part with the rear end wall 10 and in part with the associated shell segment 21L or 21R while extending vertically between the rear end flange section 6*d* and such associated shell segment 21L or 21R. Each pair of the parallel walls 41*a* and 41*b* or 42*a* and 42*b* are so positioned as to define a space therebetween in alignment with one of the outermost bolt holes 14*d* in the rear end flange section 6*d* which are located on respective sides of the two intermediate bolt holes 14*d* referred to hereinabove and immediately above the access opening 26.

In alignment with the outermost bolt holes 14*d* in the rear end flange section 6*d*, the shell segments 21L and 21R are formed with bushings generally shown by 43 in FIG. 7, for guiding associated fitting bolts 13 therethrough when the rear end flange section 6*d* as well as the other flange sections 6*a* to 6*c* is secured from below to the cylinder block 1, said bushings 43 being located between the parallel walls 41*a*, 41*b* and 42*a* and 42*b* of the respective pairs.

Each of the wall segments 21L and 21R is integrally formed with a pair of bosses 24*a* and 24*b* so defined as to extend in a direction generally parallel to the longitudinal center line Lo and as to be located generally in alignment with the opposite areas of the generally arcuate joint face 21. These bosses 24*a* and 24*b* of each pair are formed with bolt holes 23*a* and 23*b*, each extending completely through the length thereof for the passage of respective fitting bolts 22 used to connect the oil pan 3 to the clutch housing 4 through the reinforcement wall structure 7.

It is to be noted that, when the oil pan 3 is connected with the clutch housing 4 with the fitting bolts 22 passing through the bolt holes 23*a* and 23*b* in all of the bosses 24*a* and 24*b* and then firmly threaded into the clutch housing 4, a space 25 can be formed as delimited by the rear end wall 10, the rear end flange section 6*b*, the angle walls 20L and 20R, and a portion of the clutch housing 4, which space 25 is communicated to the outside through the access opening 26 unless a cover plate 27 is fitted as will be described later.

In order for the cover plate 27 to be fitted to the oil pan and, at the same time, for the angle walls 20L and 20R to be reinforced relative to the rear end wall 10, a generally U-shaped reinforcement rib having a pair of arm portions 44*a* and 44*b* and a bridge portion 44*c* connecting the arm portions 44*a* and 44*b* together is formed with the arm portions 44*a* and 44*b* integral with the respective angle walls 20L and 20R and with the bridge portion 44*c* integral with the joint between the rear end wall 10 and the bottom wall 11 as best shown in FIG. 3. The bridge portion 44*c* of the reinforcement rib 44 is formed with a pair of bosses 45 each having an internally threaded hole defined therein so as to open downwards, i.e., in a direction facing the access opening 26, for receiving a respective fitting bolt 28 used to secure the cover plate 27 to the bridge portion 44*c*. For this purpose, the cover plate 27 has a pair of bolt holes defined at 27*a* as shown in FIG. 8 for the passage of the respective fitting bolts 28 therethrough and into the threaded holes in the bosses 45.

Figure 7:
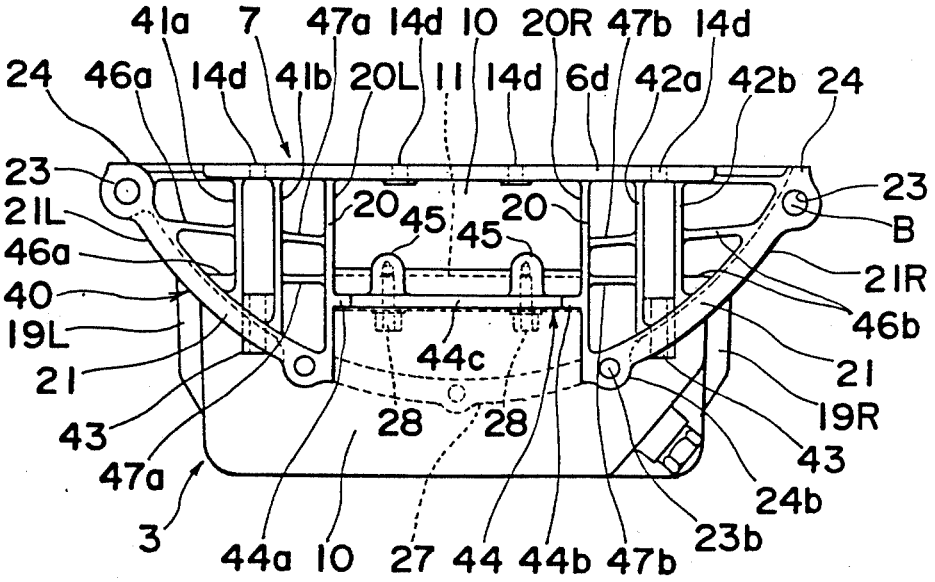
FIG. 7 is a rear end view of the oil pan.

As best shown in FIGS. 7 and 8, the wall segment 21L and the wall 41*a* are connected together by means of a plurality of, for example, two spaced horizontal ribbed walls 46*a*, and the wall 41*b* and the angle wall 20L are connected together by means of a plurality of, for example, two spaced horizontal ribbed walls 47*a*. Similarly, the wall segment 21R and the wall 42*a* are connected together by means of a plurality of, for example, two spaced horizontal ribbed walls 46*b*, and the wall 42*b* and the angle wall 20R are connected together by means of a plurality of, for example, two spaced horizontal ribbed walls 47*b*.

The cover plate 27 of a sectional shape generally similar to the inverted shape of a figure "L" also has a bolt hole 29 defined therein at a location opposite to the bolt holes 27*a* and is so shaped and so structured that, when the cover plate 27 is fitted to the bridge portion 44*c* of the reinforcement rib 44 by means of the fitting bolts 28 passing through the bolt holes 27*a* and then firmly threaded into the threaded holes in the bosses 45, a surface portion of the cover plate 27 where the bolt hole 29 is defined can lie substantially flush with the joint face 20 in each of the wall segments 21L and 21R while a major portion of the cover plate 27 closes the access opening 26.

From the foregoing description, it is clear that, before the cover plate 27 is fitted in the manner as hereinbefore described, and regardless of whether or not the clutch housing 4 has been secured to the cylinder block 1, the securement of the oil pan from below to the cylinder block 1 at a rear region of the engine, that is, at a location between the cylinder block 1 and the clutch housing 4, can be quickly and efficiently accomplished because of the provision of the access opening 26 through which some of the fitting bolts 13 to be passed through the bolt holes 14*d* in the rear end flange section 6*d* are readily accessible to the cylinder block 1 from below by way of the space 25. After the securement of the cover plate 27 to the oil pan with the fitting bolts 28 passing through the bolt holes 27*a* and then threaded firmly into the bosses 45, the fitting bolt 30 has to be passed through the bolt hole 29 and then threaded firmly into a threaded hole in the clutch housing 4 so that the access opening 26 can be completely closed. In this way, noises generated upon vibration of the power plant, which would emit to the outside unless the cover plate 27 is fitted, can be advantageously minimized.

The provision of the inner gussets 15L and 15R in combination with the center ribs 17 is effective not only to reinforce the oil pan 3 itself without substantially hampering the flow of oil within the oil pan 3, but also to facilitate a quick settlement of the oil undergoing a swelling motion within the oil pan which would occur during the drive of an automobile utilizing the power plant discussed hereinabove.

More specifically, in view of the fact that each of the gussets 15L and 15R has its height continuously decreasing in a direction from the adjacent side wall 8L or 8R towards the longitudinal center line Lo, not only can the rigidity of the oil pan 3 be substantially increased, but also any possible bias of the oil within the oil pan in a direction towards one of the side walls 8L and 8R, which bias would occur during, for example, the cornering of the automobile, can be fractioned by the adjacent gussets 15L or 15R, thereby to facilitate the quick settlement of the swelling oil within the oil pan 3. The curved intermediate portion 17*a* of one of the center ribs 17, which is located adjacent the oil strainer 18, is effective to rectify the flow of oil ready to enter the strainer 18, thereby separating from the oil air which has admixed as a result of the settlement of the swelling motion of the oil within the oil pan 3.

Moreover, since in the illustrated embodiment both the inner gussets 15L and 15R and the outer gussets 19L and 19R are substantially continued to the bosses 12*a* and 12*b*, respectively, where a relatively high rigidity is attained because of the locations at which the oil pan is secured to the cylinder block 1 by means of the fitting bolts 13, the rigidity of the oil pan can be effectively increased.

Furthermore, since the oil pan 3 including the reinforcement wall structure 7 is of one-piece construction formed by the use of any known metal casting technique, and since relatively large runners can be employed adjacent the bosses 12*a* and 12*b*, a smooth flow of molten metal, i.e., aluminum, can be advantageously facilitated even though each of the gussets 15L, 15R, 19L and 19R has a relatively thin wall, in view of the fact that the gussets 15L and 15R are substantially continued to the gussets 19L and 19R, respectively.

Although the present invention has been fully described in connections with the preferred embodiment thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. An oil pan structure of generally rectangular cup-like configuration having a rear end adapted to be connected with a clutch housing, which comprises a reinforcement wall structure formed with the oil pan structure so as to protrude away from the rear end towards the clutch housing, said reinforcement wall structure defining a space between the rear end of the oil pan structure and the clutch housing when the oil pan structure is secured to the clutch housing, said reinforcement wall structure having a portion cut away to define an access opening communicated with the space, said access opening being located immediately below at least one bolt receiving boss formed in the rear end of the oil pan structure for the passage of a fitting bolt used to connect the oil pan structure from below to a cylinder block and being open towards the clutch housing, and a cover member removably fitted to the reinforcement wall structure for closing the access opening, the cover member being of a sectional shape generally similar to the inverted shape of a figure "L" and having an upper portion adapted to be bolted to a ribbed wall integral with the oil pan structure and a lower portion adapted to be bolted to the clutch housing.

2. The oil pan structure as claimed in claim 1, wherein the oil pan structure has a deep region and a shallow region, said shallow region being defined adjacent the rear end, an upper portion of the rear end adjacent the opening of the oil pan structure being formed with a sealing region to be held in tight contact with the cylinder block, and wherein said reinforcement wall structure comprises a pair of reinforcement walls integral with the rear end of the oil pan structure and encompassing a lower portion of the rear end, said reinforcement walls having generally arcuate joint faces adapted to be held in contact with the clutch housing, said at least one bolt receiving boss being located between the reinforcement walls and immediately above the access opening.

3. The oil pan structure as claimed in claim 2, wherein at opposite ends of the joint face in each of the reinforcement walls bolt holes are defined for the passage of respective bolts therethrough for connecting the oil pan structure with the clutch housing through the reinforcement wall structure.

4. The oil pan structure as claimed in claim 3, wherein each of the reinforcement walls is formed with a bolt receiving boss located between the bolt holes in each reinforcement wall for the passage of a respective fitting bolt therethrough for connection of the oil pan structure to the cylinder block.

5. The oil pan structure as claimed in claim 4, further comprising a pair of spaced, vertically extending walls extending between each of the bolt receiving bosses and the associated bolt hole, and a plurality of horizontal ribbed walls extending between each of the wall segments and the adjacent one of the vertically extending walls.

6. The oil pan structure as claimed in claim 2, further comprising a pair of spaced wall members formed with the rear end of the oil pan structure so as to protrude in a direction away from the rear end and towards the clutch housing and terminating substantially flush with any one of the joint faces of the reinforcement walls, and a plurality of horizontal ribbed walls extending between any one of the wall members and the adjacent one of the wall segments of the reinforcement wall structure which are left by the removal of that portion of the reinforcement wall structure.

7. The oil pan structure as claimed in claim 2, wherein at least the shallow region of the oil pan structure has first and second sets of a plurality of gussets, each of the gussets of the first set being integral in part with one side wall of the oil pan structure and in part with a bottom wall of the oil pan structure, each of the gussets of the second set being integral in part with the opposite side wall of the oil pan structure and in part with the bottom wall thereof, and a plurality of center ribs each being positioned so as to bridge between one of the gussets of the first set and the associated one of the gussets of the second set generally in overlapping relationship.

8. The oil pan structure as claimed in claim 7, wherein each of the gussets of any one of the first and second sets has a height decreasing in a direction from the associated side wall towards the associated center rib.

9. The oil pan structure as claimed in claim 2, further comprising first and second sets of a plurality of gussets, each of the gussets of the first set being integral in part with one side wall of the oil pan structure and in part with a bottom wall of the oil pan structure, each of the gussets of the second pair being integral in part with the opposite side wall of the oil pan structure and in part with the bottom wall thereof, and a plurality of center ribs each being positioned so as to bridge between one of the gussets of the first set and the associated one of the gussets of the second set generally in overlapping relationship, and further comprising outer gussets protruding laterally outwardly from each of the opposite side walls of the oil pan structure in alignment with the respective gussets of the first and second sets.

10. An oil pan structure of generally rectangular cup-like configuration having a deep region and a shallow region, said shallow region being defined adjacent a rear end of the oil pan adapted to be connected with a clutch housing, an upper portion of the rear end adjacent the opening of the oil pan structure being formed with a sealing region to be held in tight contact with a cylinder block, the oil pan comprising a reinforcement wall structure formed with the oil pan structure so as to protrude away from the rear end towards the clutch housing, said reinforcement wall structure defining a space between the rear end of the oil pan structure and the clutch housing when the oil pan structure is secured to the clutch housing, said reinforcement wall structure having a portion cut away to define an access opening communicated with the space, and a plurality of reinforcement walls integral with the rear end of the oil pan structure and encompassing a lower portion of the rear end, said reinforcement walls having generally arcuate joint faces adapted to be held in contact with the clutch housing, said at least one bolt receiving boss being located between the reinforcement walls and immediately above the access opening, said access opening being located immediately below at least one bolt receiving boss formed in the rear end of the oil pan structure for the passage of a fitting bolt used to connect the oil pan structure from below to a cylinder block and being open towards the clutch housing, and a cover member removably fitted to the reinforcement wall structure for closing the access opening, the cover member being of a sectional shape generally similar to the inverted shape of a figure "L" and having an upper portion adapted to be bolted to a ribbed wall integral with the oil pan structure and a lower portion adapted to be bolted to the clutch housing.

* * * * *